United States Patent [19]

Catanese et al.

[11] 4,109,178

[45] Aug. 22, 1978

[54] ELECTRON MULTIPLIER WITH SWITCHABLE BEAM CONFINEMENT STRUCTURE

[75] Inventors: Carmen Anthony Catanese, Rocky Hill; John Guiry Endriz; Scott Allen Keneman, both of Trenton, all of N.J.

[73] Assignee: RCA Corporation, New York, N.Y.

[21] Appl. No.: 794,132

[22] Filed: May 5, 1977

[51] Int. Cl.[2] ..... H01J 29/41

[52] U.S. Cl. ..... 315/12 R; 313/103 CM; 313/105 CM; 250/213 VT

[58] Field of Search ..... 315/12 R; 313/103 R, 313/103 CM, 105 R, 105 CM, 400; 250/213 VT

[56] References Cited

U.S. PATENT DOCUMENTS

| | | | |
|---|---|---|---|
| 4,028,575 | 6/1977 | Van Raalte | 313/105 R |
| 4,041,342 | 8/1977 | Catanese et al. | 313/105 R |

*Primary Examiner*—Maynard R. Wilbur
*Assistant Examiner*—T. M. Blum
*Attorney, Agent, or Firm*—Eugene M. Whitacre; Donald S. Cohen; George E. Haas

[57] ABSTRACT

An electron multiplier includes a plurality of staggered parallel dynodes. The dynodes include spaced confinement bumps along their lengths with active multiplying areas between the bumps. The confinement bumps and active areas therebetween define a plurality of channels which extend from a cathode at one end of the multiplier to the output end. Each channel traverses the staggered parallel dynodes and causes an electron beam to pass therethrough without substantial spreading. The electron multiplier includes additional structure for creating a high gain condition in the channels which are desired to be in an "on" condition while simultaneously creating a low gain condition in the adjacent channels. Electrical potentials can be simply switched at the dynodes so as to change this first condition into a second condition where the relative gain parameters of the channels are reversed.

19 Claims, 10 Drawing Figures

ELECTRON MULTIPLIER WITH SWITCHABLE BEAM CONFINEMENT STRUCTURE

BACKGROUND OF THE INVENTION

This invention relates to electron multipliers, and particularly to a multiplier structure having channels for confining the flow of electrons therethrough in which additional means are provided for establishing a high multiplier gain condition in an "on" channel while simultaneously establishing a low gain condition in channels adjacent thereto.

Display devices have been proposed in which electron multipliers operated in a feedback mode are used to provide current to light up a cathodoluminescent screen. For example, see U.S. Pat. No. 3,904,923 entitled, "Cathodoluminescent Display Panel", issued Sept. 9, 1975 to J. Schwartz. In one such structure, the electron multiplier includes at least two vanes having a plurality of parallel dynodes in staggered relation thereon with a cathode at one end. This structure is further described in copending application of Endriz et al, Ser. No. 672,122, filed Mar. 21, 1976 entitled, "Parallel Vane Structure for a Flat Display Device." In this structure, electrical potentials of increasing magnitude are provided to the successive multiplying dynodes so as to produce an electron beam at the multiplier output. Generally, the electron multiplier has an open structure to allow feedback of ions which results in sufficiently high loop gain to produce sustained electron emission.

A requirement of such a display is that the electron beam be confined to an area of the screen which is no larger than one picture element. However, in the previously described electron multipliers, spreading of the electron beam occurs in a direction along the length of the dynodes. This spreading problem is substantially attenuated by the use of a nonplanar dynode structure wherein confinement bumps help to confine the flow of electrons through predetermined channels. Further information on the confinement bump structure and operation are found in copending application, Ser. No. 714,358, entitled "Electron Multiplier with Beam Confinement Structure," by Catanese and Keneman, filed Aug. 16, 1976, now U.S. Pat. No. 4,041,342 which is hereby incorporated by reference.

Although the confinement structure shown in copending application, Ser. No. 714,358 is effective in confining electron flow in the desired channels while discouraging electron flow and multiplication in the space between channels, it suffers from the disadvantage that it affords no relief for the situation in which an electron skips from one channel to an adjacent channel. This can be further appreciated by the fact that, in the previously discussed embodiment, in which the cathode electrode is used for addressing purposes, all of the channels along a single pair of insulating vanes (not just the "on" channel(s)) are generally in a high multiplier gain condition. This means that any electrons which manage to get out of the confinement channel and into an adjacent channel ("off" channel) will be multiplied and accelerated toward the screen, causing a loss of spot resolution and an undesirable output. Although the previously discussed structure is quite effective in minimizing the number of electrons which are able to pass through to adjacent "off" channels, the presence of these remaining electrons is amplified by two factors. One factor is the previously discussed multiplication factor. Another factor is that the resulting gain in the "off" channels is not degraded by space charge saturation means as is the case in the higher current "on" channel.

Thus, it would be desirable to develop an electron multiplier structure in which the advantages of the electron beam confinement structure shown in copending application, Ser. No. 714,358, are maintained but which further includes the ability to substantially prevent the multiplication of electrons in "off" channels which are adjacent to "on" channels.

SUMMARY OF THE INVENTION

An electron multiplier includes at least two spaced substrates of electrically insulating material with a cathode at one end of the substrate. A plurality of parallel dynodes are on the surfaces of the substrates which face each other with the dynodes on one of the surfaces being in staggered relation to the dynodes on the other of the surfaces. At least some of the dynodes include nonplanar structure periodically along the length thereof. The nonplanar structure forms a plurality of substantially parallel spaced channels. The channels extend from the cathode and traverse the parallel dynodes. The electron multiplier includes means responsive to a first set of discrete electrical potentials applied to separate ones of the dynodes for establishing a relatively high electron multiplier gain condition in at least one of the channels while simultaneously establishing a relatively low electron multiplier gain condition in channels adjacent thereto. The means are responsive to a second set of discrete electrical potentials applied to separate ones of the dynodes for establishing a relatively low electron multiplier gain condition in the one channel while simultaneously establishing a relatively high electron multiplier gain condition in the adjacent channels. The electron multiplier can be employed in an image display device.

DETAILED DESCRIPTION OF THE INVENTION

Figure 1:
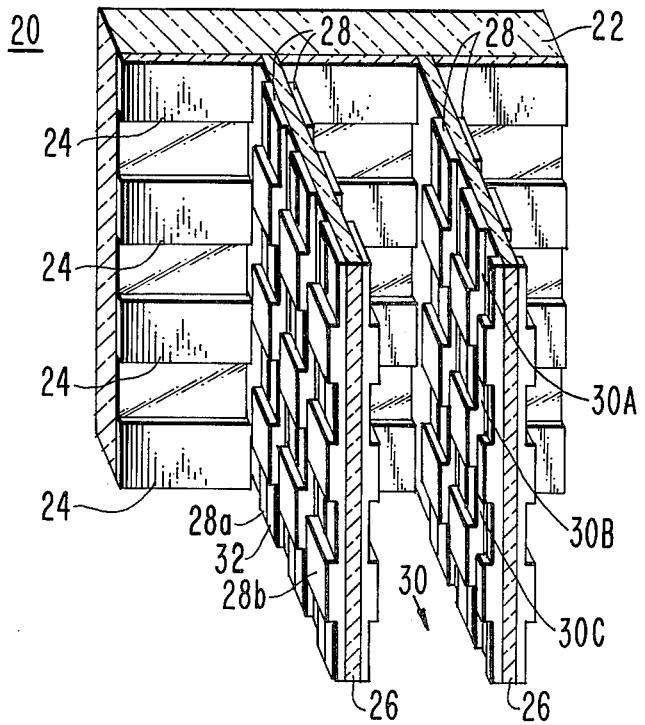
FIG. 1 is a perspective view of a portion of one form of the electron multiplier of the present invention.
Figure 2A:
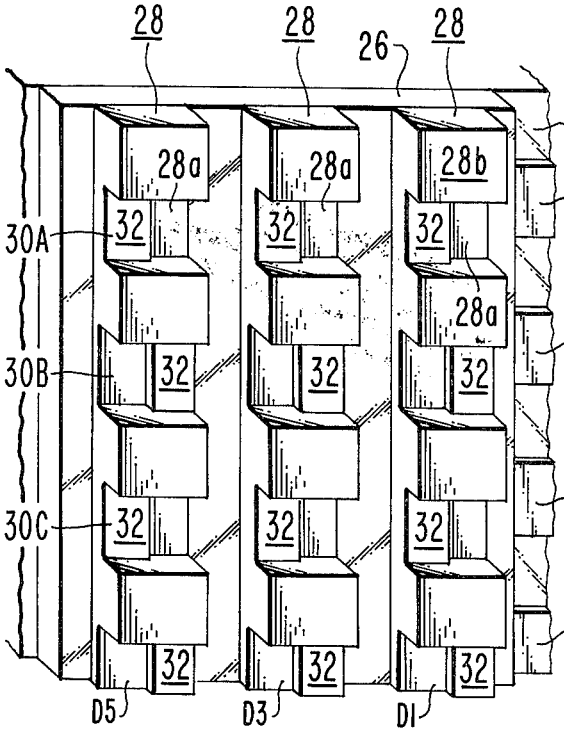
FIGS. 2*a* and 2*b* are plan views of a portion of the opposing surfaces of the vane structure of the electron multiplier of FIG. 1.
Figure 2B:
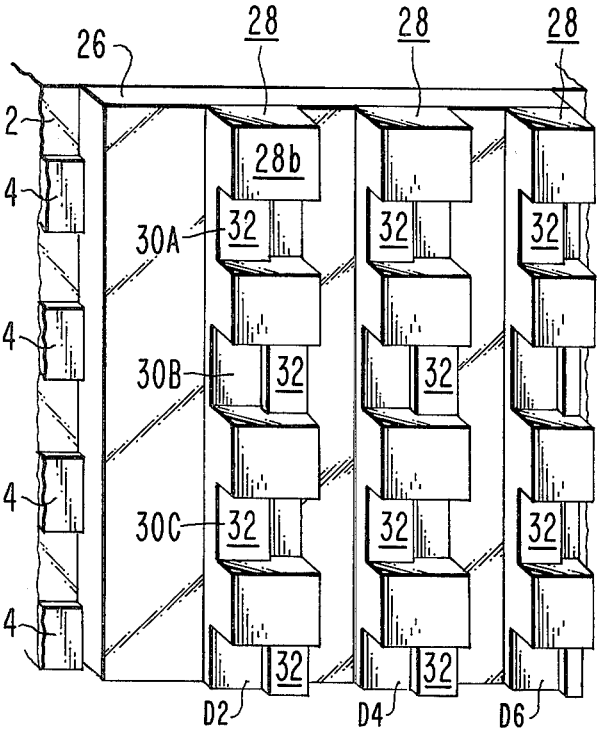

Referring now to FIGS. 1, 2*a* and 2*b*, a portion of one form of electron multiplier of the present invention is generally designated as 20. The electron multiplier 20 includes a back panel 22 having a plurality of cathode stripes 24 on its inside surface. Each cathode stripe 24 is of a conductive material, such as a metal, which may be coated with a thin layer of material that provides high electron emission under bombardment by feedback species, such as ions and photons. For example, in the case of ion feedback, the emissive material may be MgO or BeO. A plurality of spaced parallel insulating vanes 26 are in perpendicuar contact with the back panel 22. The vanes 26 are arranged orthogonal to the cathode stripes 24. Each of the vanes 26 is formed from flat insulating material, such as glass or ceramic. Each vane 26 includes on each of its major surfaces a plurality of spaced, parallel electron multiplier dynodes 28 which are in orthogonal relation with respect to the cathode stripes 24.

The dynodes 28 on the surfaces of the vanes 26 which face each other are disposed in staggered relation. The dynodes 28 include a nonplanar structure, e.g., confinement bumps **28*b* which are rectangularly shaped and arranged periodically along the length of the dynodes. Each adjacent pair of confinement bumps 28*b* along the length of the dynode 28 includes an active dynode multiplying area 28*a* therebetween. Thus, the confinement bumps form channels 30 (30A, 30B, 30C . . . ) from the cathode stripes 24 in directions orthogonal to the parallel dynodes 28**.

The structure and operation of the electron multiplier 20 heretofore discussed is more fully described in previously mentioned copending application Ser. No. 714,358.

The electron multiplier 20 of the present invention further includes means for establishing a condition in which, when one of the electron multiplier channels 30 is in a relatively high multiplier gain condition ("on" condition), the adjacent channels are in a relatively low electron multiplier gain condition ("off" condition).

Figure 3B:
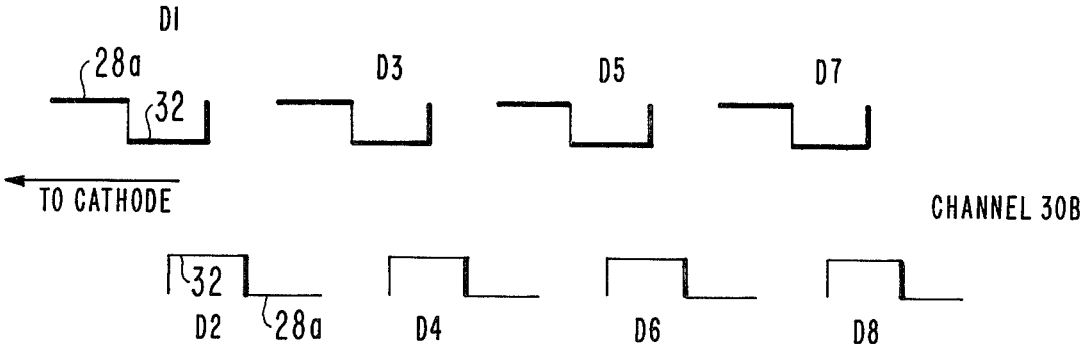
FIGS. 3*a* and 3*b* are diagrammatic views showing more clearly the relative positioning of the vanes and dynodes thereon in the electron multiplier of FIG. 1.
Figure 3A:
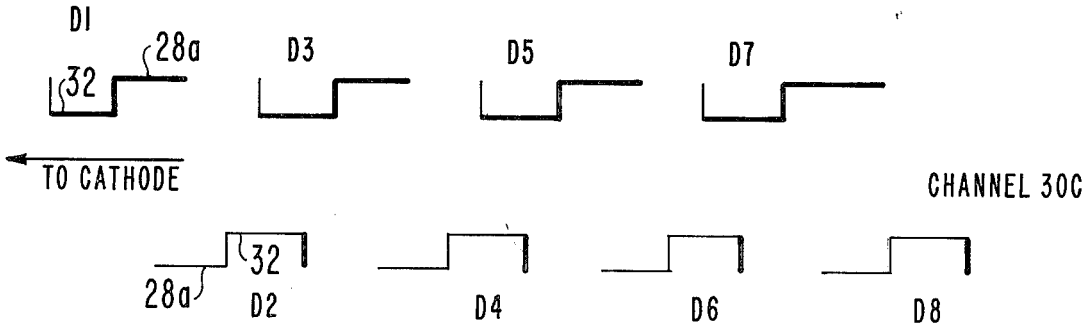

In one embodiment, this high gain/low gain condition is accomplished by the presence of spoiler structure in the channels 30. Referring now to FIGS. **2*a*, 2*b*, and FIGS. 3*a*, 3*b*, the spoiler structure will be described more particularly. In these FIGURES, the dynodes 28 are, for purposes of clarity, further designated as D1, D2 . . . D5** in order to show their staggered relation.

In FIG. **2*a*, where a portion of one surface of an insulating vane is shown, it can be seen that each channel 30A, 30B, 30C, includes spoiler surfaces 32 which are raised in relation to the active dynode areas 28*a*. The spoiler surfaces 32 are disposed such that, in each channel 30A, 30B, 30C on the vane, the position of the spoiler surface 32 is consistently on only one portion of the active dynode area 28*a*. For example, channels 30A and 30C of FIG. 2*a* include spoiler surfaces 32 only on the portion of the active areas 28*a* which is furthest from the cathode. It is important to note that the position of the spoiler surfaces 32 changes from one channel to the adjacent channel, i.e., spoiler surfaces 32 furthest from the cathode in channels 30A, 30C, spoiler surfaces 32 closest to the cathode in channel 30B. Referring now to FIG. 2*b*, which shows a portion of the opposing surface of an adjacent vane, it can be seen that the structure is substantially the same as that of FIG. 2*a*. There is, however, one significant difference: channels 30A, B, C of FIG. 2*b* include spoiler surfaces 32 which are in an opposite position to the corresponding channels of FIG. 2*a*. That is, in FIG. 2*b*, spoiler surfaces 32 in channels 30A, 30C are closest to the cathode while spoiler surfaces 32 in channel 30B are furthest from the cathode. Note that the proper positioning of the vanes 26 shown in FIGS. 2*a*, 2*b* require that each of the vanes be rotated about an axis in the plane of the drawing, parallel to the dynode length and toward the viewer. See also FIGS. 3*a*, 3*b*, which show diagrammatic top views of two channels in the electron multiplier 20 of FIG. 1**.

Generally, in the operation of the electron multiplier 20 of the present invention shown in FIG. 1, the cathode stripes 24 provide input electrons for the dynodes 28. For example, in one embodiment, if the cathode stripe 24 is electrically more negative than the first dynode, electrons emitted by the stripe will be attracted to the first dynode whereas if the cathode stripe is more positive than the first dynode, the emitted electrons will not reach the first dynode. This allows the electron flow in the output of the multiplier to be turned on and off in various regions by biasing various cathode stripes 24. Increasing voltages are applied to the multiplier dynodes from the dynode closest to the cathode stripes to the dynode closest to the multiplier output. The multiplier is initially fired or started by primary electrons emitted from the cathode which may be caused by cosmic or other external radiation impinging thereon, or by other causes.

In contrast to the operation of prior art electron multiplier structures where the voltage distribution applied to the dynodes is uniform in the present invention, an asymmetric voltage distribution is applied to the dynodes, as shown diagrammatically in FIGS. **4*a*, 4*b*. Note that, in FIGS. 4*a*, 4*b* the multiplier dynodes 28 are simply referred to as D1 . . . 8** and the electrical potentials applied thereto are shown parenthetically.

Referring now to FIG. **4*a*, the relative gain condition of adjacent channels 30C and 30B will be discussed. Note that the voltage changes ($\Delta V$) from odd numbered dynodes (D1, 3 . . . 7) to even numbered dynodes (D2, 4 . . . 8) is smaller than the voltage changes from even to odd dynodes. This voltage asymmetry, combined with the raised spoiler surfaces 32, results in high multiplier gain in channel 30B, but low gain in channel 30C. This difference in electron multiplier gain can be appreciated by reference to the electron trajectories shown in FIG. 4*a*. Note that, as seen in channel 30C, the relative orientation of the spoiler surfaces 32 functions to steer some electrons in the nonemitting portion of the higher voltage dynodes. Note also, that in channel 30C, some of the electrons skip dynodes so that electron multiplication is further decreased. The condition of channel 30C is to be contrasted with the condition of channel 30B. In channel 30B, the spoiler surface orientation and applied voltages do not degrade the multiplier performance. Instead, electrons are steered from the emitting portion of one dynode to the emitting portion of the next dynode. Further in connection with FIG. 4*a*, it is important to note that the relatively high gain condition of channel 30B and the relatively low gain condition of channel 30C are simultaneously accomplished through the identical electrical potentials at each of the dynodes D1–D8. It is to be appreciated that this high gain/low gain condition between adjacent channels 30C, 30B** is highly desirable as it means that when only one of the channels is desired to be "on", the other channel (adjacent channel) will be in a spoiled state, i.e., "off".

Figure 4:
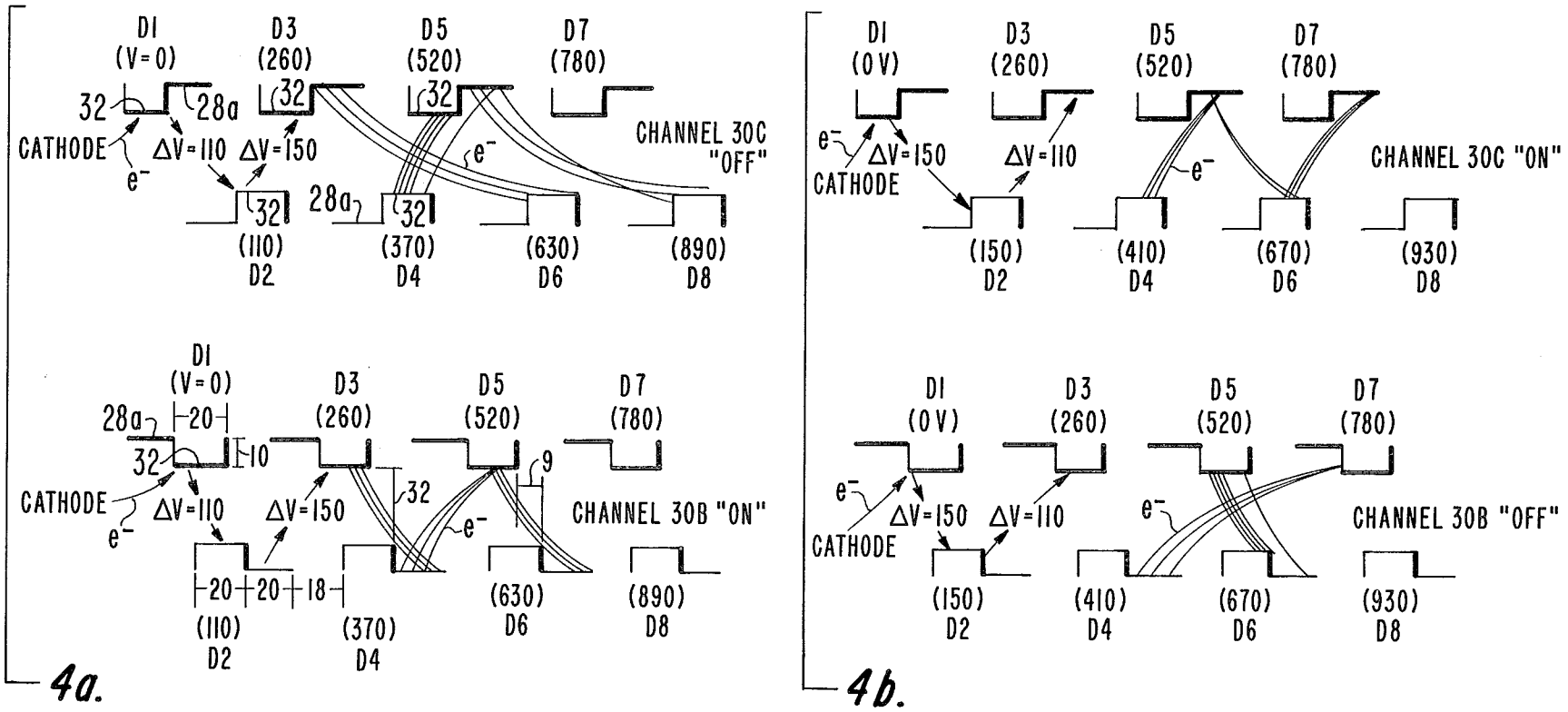
FIGS. 4*a* and 4*b* are diagrammatic views showing the electron multiplier gain condition of adjacent channels with electrical potentials being shown in parentheses.

Now, when channel 30C is desired to be in the relatively high gain condition ("on") and channel 30B is desired to be in the relatively low gain condition ("off"), simple electrical switching techniques provide the desired result. For example, if the set of discrete electrical potentials shown in FIG. **4*a*** is switched to a second set of electrical potentials in which the lower voltage change ($\Delta V$) occurs in going from even to odd numbered dynodes, the electron trajectories are interchanged. This is shown in FIG. 4*b* where the switching is quite simply accomplished by increasing each of the electrical potentials of the even dynodes D2 . . . 8 by 40 volts. In general, the amount of voltage asymmetry, i.e., switching voltage, required for a situation in which a high gain channel is adjacent to low gain channels depends upon the height of the spoiler surfaces 32. Typically, the greater the spoiler surface 32 height in relation to the active area 28*a*, the greater will be the voltage difference and the greater will be the gain difference between the "on" and "off" channels.

Although the previous discussion has, for purposes of clarity, been directed toward the operation of two adjacent channels 30B and 30C, it is important to appreciate that the electron multiplier of the present invention typically comprises more than two of such channels. More particularly, the electron multiplier of the present invention includes a plurality of channel combinations such as 30B, 30C where the multiplier can be said to include: a first set of alternate channels, all of which are substantially identical to 30B; and a second set of alternate channels, all of which are substantially identical to 30C.

Figure 5:
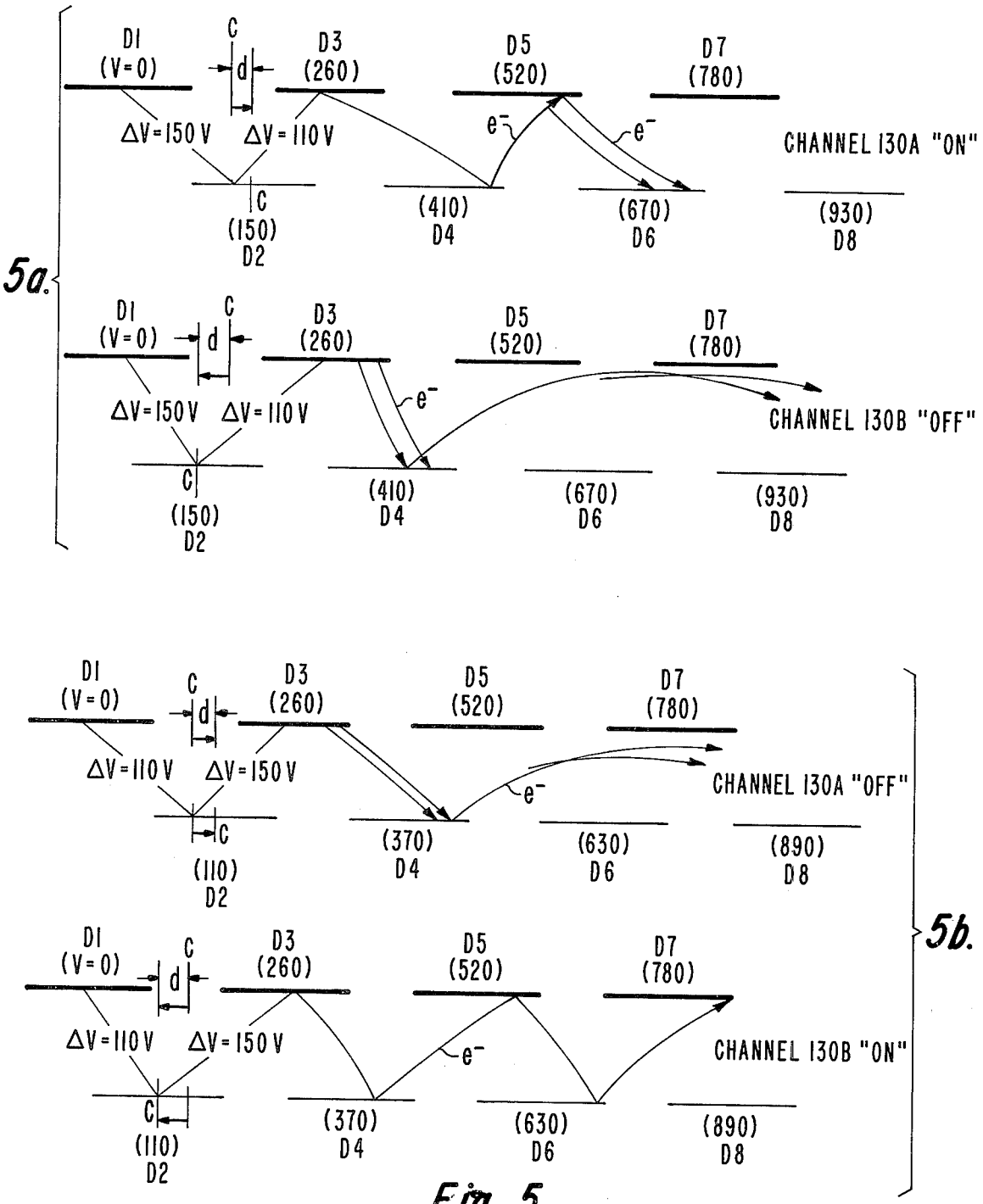
FIGS. 5*a* and 5*b* are diagrammatic representations of another embodiment of the electron multiplier of the present invention with electrical potentials being shown in parentheses.

In another embodiment of the electron multiplier of the present invention, the active dynode area in the channels includes no nonplanar structure, i.e., no raised spoiler surfaces. A portion of such a structure is diagrammatically shown in FIGS. 5*a*, 5*b*. In FIGS. 5*a*, 5*b* the relative multiplier gain ratio between the adjacent channels 130A and 130B is achieved by shifting the centers of the active areas 28*a* of the dynodes a distance relative to the symmetrical geometry typical of the dynode arrangement shown in copending application, Ser. No. 714,358.

More particularly, referring to channel 130A of FIG. 5*a*, the centers (C) of the even numbered dynodes are shifted a distance *d* to the right of the center (C) of the space between the odd numbered dynodes. In channel 130B the centers of the even numbered dynodes are shifted a distance *d* to the left of the center of the space between odd numbered dynodes. This center shift, together with an asymmetric voltage distribution wherein the voltage change ($\Delta V$) is 150 volts from odd to even dynodes and 110 volts from even to odd dynodes, results in a relatively high multiplier gain condition in channel 130A while simultaneously establishing a relatively low gain condition in the adjacent channel 130B, as shown by the electron trajectories of FIG. 5*a*. However, if the voltage asymmetry is reversed, e.g., as in FIGS. 4*a*, 4*b*, by switching the even dynodes down 40 volts, channel 130*b* will have high gain and channel 130A will have low gain, as shown in FIG. 5*b*. In general, the amount of voltage asymmetry required for a particular high gain-low gain relationship depends upon the amount of shift, i.e., dynode asymmetry, and can be calculated from basic electron optics.

Figure 6:
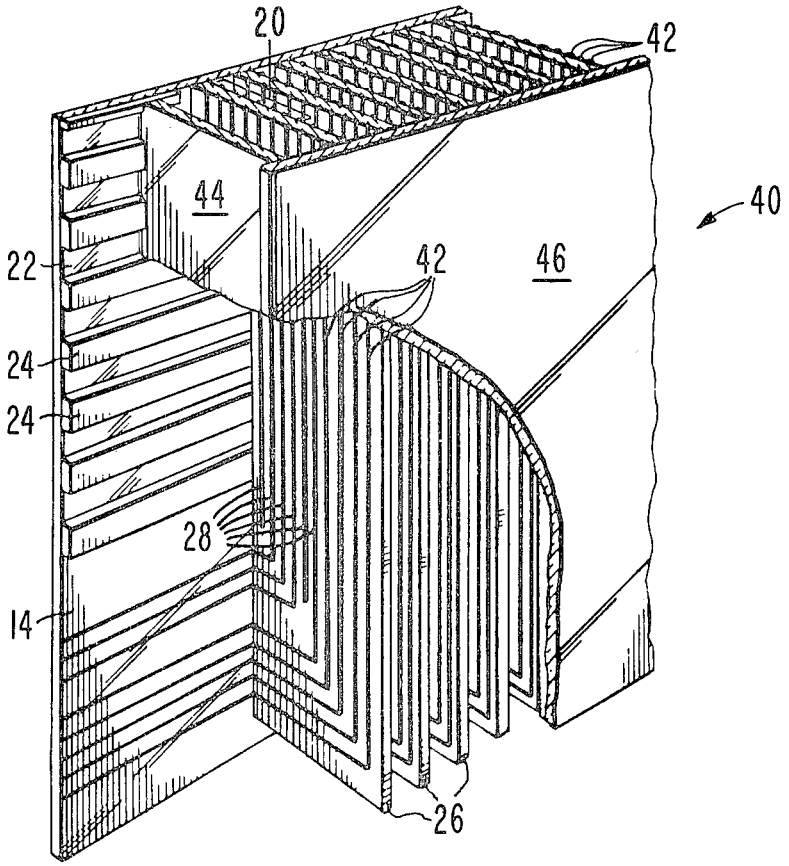
FIG. 6 is a perspective view of a portion of a flat panel image display device including the electron multiplier of the present invention.

The electron multiplier of the present invention is particularly suitable for use in a flat panel image display device. One such flat panel image display device is partially shown in FIG. 6 and is generally designated 40. The device 40 may be of the type described in previously mentioned copending application Ser. No. 672,122 which is hereby incorporated by reference. The display device 40 includes as an electron source the electron multiplier of the present invention. In such a case, the electron multiplier 20 is designed to include a plurality of insulating vanes 26 positioned to provide for the desired number of horizontal picture elements. Also, the electron multiplier includes a sufficient plurality of cathode stripes 24 so as to provide for the desired number of horizontal display lines. Still further, the electron multiplier structure is provided with sufficient electrode structure 42 following its output so as to enable it to be suitably controlled. The image display device 40 includes side walls 44 and a front panel 46 upon which is disposed a cathodoluminescent screen (not shown) which is responsive to the electron output of the electron multiplier.

In the operation of the display device 40, which includes the electron multiplier of the present invention, a given line is turned on by switching only the cathode associated with that line into the "on" state. The current output for the multiplier channel associated with the turned-on cathode then builds up to a saturation value which is limited by space-charge effects. Some electrons spill over from the "on" channel to the adjacent channels which are desired to be in the "off" condition. However, due to the selection mechanism of the present invention, the electron multiplier gain in the adjacent channels is much lower than the "on" channel such that the spillover electrons are not appreciably multiplied. Although the channels following the adjacent "off" channels are also in the "on" state, these "on" channels are sufficiently distant from the desired "on" channel so that there is substantially no electron spillover thereto.

The operation of the display device 40 can be conveniently accomplished where a television type display employing conventional field interlace addressing is desired. In such a case, the insulating vanes run vertically with horizontal line select cathodes, and the multiplier state remains the same while every other line is addressed during a single field time. After all of the even (or odd) lines in one sequence are addressed, the asymmetric voltages are switched so that the formerly high gain lines are in the low gain state and the formerly low gain lines are in the high gain state. After this switching, the second field is addressed within the frame time.

A significant advantage of the structure of the present invention is that the presence of the high gain/low gain condition is simply accomplished through the switching from one set of electrical potentials to a second set of electrical potentials. Further, this switching need only occur on one of the sets of opposing dynodes. In this connection, it is important to further note that each of the dynodes requires only one electrical switch even though there may be as many as 500 insulating plates with 500 channels whose electrical properties must be varied.

Thus, there is provided by the present invention, structures which provide a relatively high electron multiplier gain condition in the desired "on" channels while at the same time providing a low electron multiplier gain condition in the adjacent channels. The structures allow for simple electrical control. The electron multiplier structure is particularly suitable for use in a flat panel image display device in which relatively small picture element size may be a requirement.

We claim:

1. An electron multiplier, comprising:

at least two spaced substrates of electrically insulating material;

a cathode at one end of said substrate;

a plurality of parallel dynodes on the surfaces of said substrates which face each other; said dynodes on one of said surfaces being in staggered relation to said dynodes on the other of said surfaces with at least some of said dynodes including a nonplanar structure periodically along the length thereof, said nonplanar structure forming a plurality of substantially parallel spaced channels, said channels extending from said cathode and traversing said parallel dynodes; and means responsive to a first set of discrete electrical potentials applied to separate ones of said dynodes for establishing a relatively high electron multiplier gain condition in at least one of said channels while simultaneously establishing a relatively low electron multiplier gain condition in channels adjacent thereto, said means being responsive to a second set of discrete electrical potentials applied to separate ones of said dynodes for establishing a relatively low electron multiplier gain condition in said one channel while simultaneously establishing a relatively high electron multiplier gain condition in said adjacent channels.

2. An electron multiplier in accordance with claim 1 in which said plurality of channels comprises a first set of alternate ones of said channels which are substantially the same and a second set of said channels comprises the remaining alternate ones of said channels which are substantially the same but in which said channels of said first set are not substantially the same as said channels of said second set.

3. An electron multiplier in accordance with claim 1 in which at least some of said dynodes include spoiler structure in said channels, said spoiler structure being positioned so as to degrade the electron multiplier gain of said channels upon establishment of at least one of said sets of electrical potentials.

4. An electron multiplier in accordance with claim 3 in which said spoiler structure comprises spoiler surfaces which are raised in relation to the remaining surfaces of said dynodes.

5. An electron multiplier in accordance with claim 4 in which at least some of said dynodes on said facing surfaces of said substrates include said spoiler surfaces.

6. An electron multiplier in accordance with claim 5 in which said spoiler surfaces of said dynodes on each of said facing surfaces are respectively disposed on substantially the same portions of said dynodes with said spoiler surfaces on one of said facing surfaces being disposed on different portions than the spiler surfaces of the facing surface.

7. An electron multiplier in accordance with claim 6 in which said portions of one of said facing surfaces are those portions of said dynodes closest to said cathode and in which said portions of the other of said facing surfaces are those portions of said dynodes furthest from said cathode.

8. An electron multiplier in accordance with claim 7 in which the positioning of said portions of said dynodes on each of said facing surfaces is reversed as between adjacent ones of said channels.

9. An electron multiplier in accordance with claim 3 in which said spoiler structure comprises dynodes which are disposed asymmetrically.

10. An electron multiplier in accordance with claim 9 in which the centers of said dynodes in said channels are positioned such that the distance between consecutive dynode centers is nonuniform.

11. An image display device, comprising:

an evacuated envelope including a transparent front panel and a back panel spaced from said front panel, said front panel having a cathodoluminescent screen thereon;

means for generating a plurality of substantially parallel beam sources of electrons;

a plurality of spaced substantially parallel vanes between said front and back panels, said vanes being substantially orthogonal to said beam sources;

a plurality of parallel dynodes disposed on opposing surfaces of said vanes with said dynodes which face each other being in staggered relation to said dynodes on the other of said surfaces with at least some of said dynodes including a nonplanar structure periodically along the length thereof, said nonplanar structure forming a plurality of substantially parallel spaced channels for confining said beam sources of electrons; and means responsive to a first set of discrete electrical potentials applied to separate ones of said dynodes for establishing a relatively high electron multiplier gain condition in a first set of alternate ones of said channels while simultaneously establishing a relatively low multiplier gain condition in the remaining set of alternate channels, said means being responsive to a second set of discrete electrical potentials applied to separate ones of said dynodes for establishing a relatively low gain condition in said first set of alternate channels while simultaneously establishing a relatively high gain condition in said second set of alternate channels.

12. An image display device in accordance with claim 11 in which at least some of said dynodes include spoiler structure in said channels, said spoiler structure being positioned so as to degrade the electron multiplier gain of said channels upon establishment of at least one of said sets of electrical potentials.

13. An image display device in accordance with claim 12 in which said spoiler structure comprises spoiler surfaces which are raised in relation to the remaining surface of said dynodes.

14. An image display device in accordance with claim 13 in which at least some of said facing dynodes include said spoiler surfaces.

15. An image display device in accordance with claim 14 in which said spoiler surfaces of said facing dynodes on each of said facing vane surfaces are respectively disposed on substantially the same portions of said dynodes with said spoiler surfaces on one of said facing vane surfaces being disposed on different portions than the spoiler surfaces of the other facing vane surface.

16. An image display device in accordance with claim 15 in which said portions of one of said facing dynodes are those portions of said dynodes closest to said cathode and in which said portions of the other of said facing dynodes are those portions of said dynodes furthest from said cathode.

17. An image display device in accordance with claim 16 in which the positioning of said portions of said dynodes on each of said facing surfaces is reversed as between adjacent ones of said channels.

18. An image display device in accordance with claim 12 in which said spoiler structure comprises dynodes which are disposed asymmetrically.

19. An image display device in accordance with claim 18 in which the centers of said dynodes in said channels are positioned such that the distance between consecutive dynode centers is nonuniform.

* * * * *